United States Patent [19]

Butterworth et al.

[11] Patent Number: 4,766,273

[45] Date of Patent: Aug. 23, 1988

[54] HIGH CURRENT DOUBLE-BREAK ELECTRICAL CONTACTOR

[75] Inventors: Edmund M. Butterworth, Bedford, England; Daniel A. Wycklendt, Milwaukee, Wis.

[73] Assignee: Eaton Corporation, Cleveland, Ohio

[21] Appl. No.: 745,765

[22] Filed: Jun. 17, 1985

[51] Int. Cl.[4] ..... H01H 33/20

[52] U.S. Cl. ..... 200/147 R; 200/144 R; 335/196

[58] Field of Search ..... 200/144 R, 147 R; 335/196

[56] References Cited

U.S. PATENT DOCUMENTS

| | | | |
|---|---|---|---|
| 4,023,885 | 5/1977 | Snowdon et al. | 335/196 |
| 4,401,863 | 8/1983 | Lemmer et al. | 335/196 |
| 4,568,805 | 2/1986 | Wycklendt | 200/147 R |
| 4,618,748 | 10/1986 | Mueller | 200/147 R |

FOREIGN PATENT DOCUMENTS

| | | | |
|---|---|---|---|
| 1160922 | 1/1964 | Fed. Rep. of Germany | 200/144 R |
| 49029 | 2/1965 | Poland | 200/144 R |
| 1121012 | 7/1968 | United Kingdom | 200/144 R |

*Primary Examiner*—Robert S. Macon
*Attorney, Agent, or Firm*—L. G. Vande Zande

[57] ABSTRACT

Stationary contact, terminal and arc-runner structure for a high-current double-break electrical contactor that affords longer contact life. Each stationary contact (66,80) and turn-back arc-runner (68,82) is connected to the associated terminal (52,72). Each arc-runner (68,82) is V-shaped and has a slot (**68*e*,82*e*) at its turn-back or bight portion (68*b*,82*b*) through which the associated stationary contact (66,80) extends so that its contact tip (66*b*,80*b*) is thereabove for engagement by the bridging contact (36). The stationary contacts (66,80) allow substantially straight-through current flow, no turn-back current loop, when the contacts (66,36,80) are closed under normal current conditions to retain maximum contact pressure. But at the moment of the contact opening under high overload current conditions, the arcs migrate toward the sides between the arc-runners (68*c*,82*c*) and the outer ends of the bridging contact (36) so that a turn-back condition occurs in the current flow path inducing heavy magnetic blowout forces on the respective arcs outwardly and upwardly toward the splitter plates (88,90**) to efficiently extinguish the arcs.

2 Claims, 3 Drawing Sheets

Fig. 3
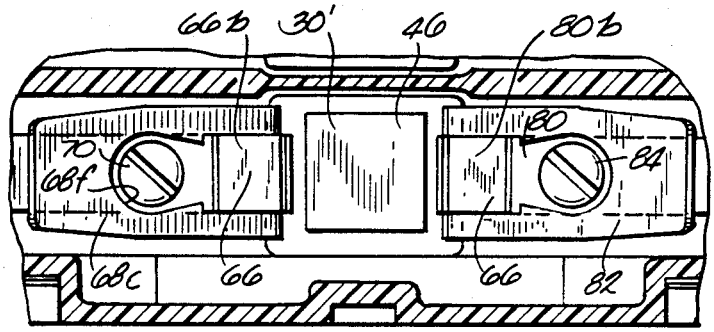
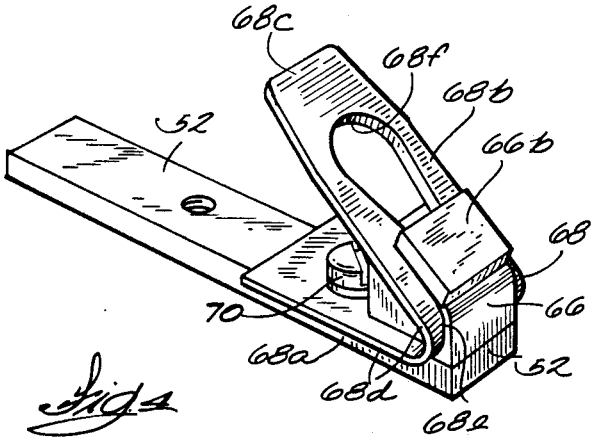
Fig. 4

HIGH CURRENT DOUBLE-BREAK ELECTRICAL CONTACTOR

BACKGROUND OF THE INVENTION

Double-break contacts wherein the stationary contacts have a turn-back configuration whereby current flow therethrough will induce a laterally outwardly directed magnetic blowout force have been known heretofore. For example, A. C. Snowdon et al U.S. Pat. No. 4,023,885 dated May 17, 1977, shows double-break contacts of that type wherein the stationary contact carrying terminals have a turn-back configuration causing the current arcs upon contact opening to provide magnetic fields in directions to force such arcs outwardly. While such contacts have been useful for their intended purposes, they have nevertheless been handicapped by the fact that while the turn-back configuration and consequent laterally outward arc blowout forces are desirable for high current interruption when the contacts open, they are undesirable during the high inrush currents when the contacts close because they tend to force the contacts open which in turn produces secondary arcs which abrade the contact material resulting in increased contact wear and a tendency for the contacts to weld closed. Therefore, it has been found to be desirable to provide double-break contacts designed and constructed so as to afford increase in the contact pressure on closing while retaining the laterally outward arc blowout forces on high current opening.

SUMMARY OF THE INVENTION

An object of the invention is to provide an improved high current double-break electrical contactor.

A more specific object of the invention is to provide double-break electrical contacts with improved means to afford increase in the contact pressure due to high inrush current on closing while providing laterally outward arc blowout magnetic forces on high current interruption of the contacts.

Another specific object of the invention is to provide improved double-break contacts having a straight-through current flow configuration to increase the contact pressure upon closing of the contacts in combination with a turn-back current flow configuration to induce laterally outward arc blowout forces upon opening of the contacts for high current interruption.

Another specific object of the invention is to provide double-break contacts of the aforementioned type that are simple in construction and economical to manufacture.

Other objects and advantages of the invention will hereinafter appear.

BRIEF DESCRIPTION OF THE DRAWINGS

FIG. 3 is a fragmentary horizontal cross sectional view taken substantially along line 3—3 of FIG. 1 to show a top view of the terminals, the stationary contacts and their associated arc runners.

FIG. 4 isometric view of one of the stationary contacts and associated arc runner.

DESCRIPTION OF THE PREFERRED EMBODIMENT

Figure 1:
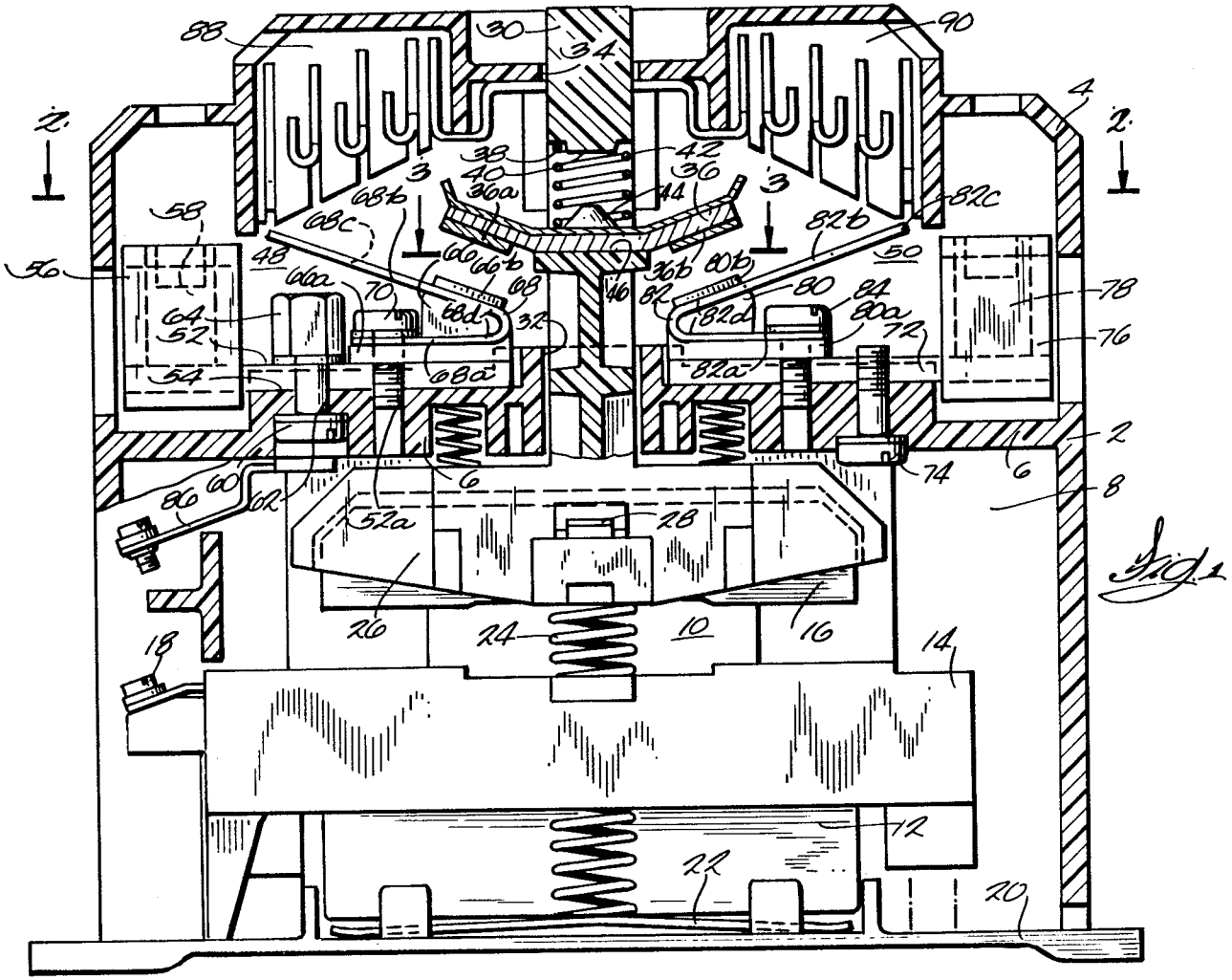
FIG. 1 is a vertical cross sectional view of the high current double-break electrical contactor taken substantially along line 1—1 of FIG. 2 to show the stationary and movable contacts, terminals, arc runners, the arc splitter structure electromagnet.
Figure 2:
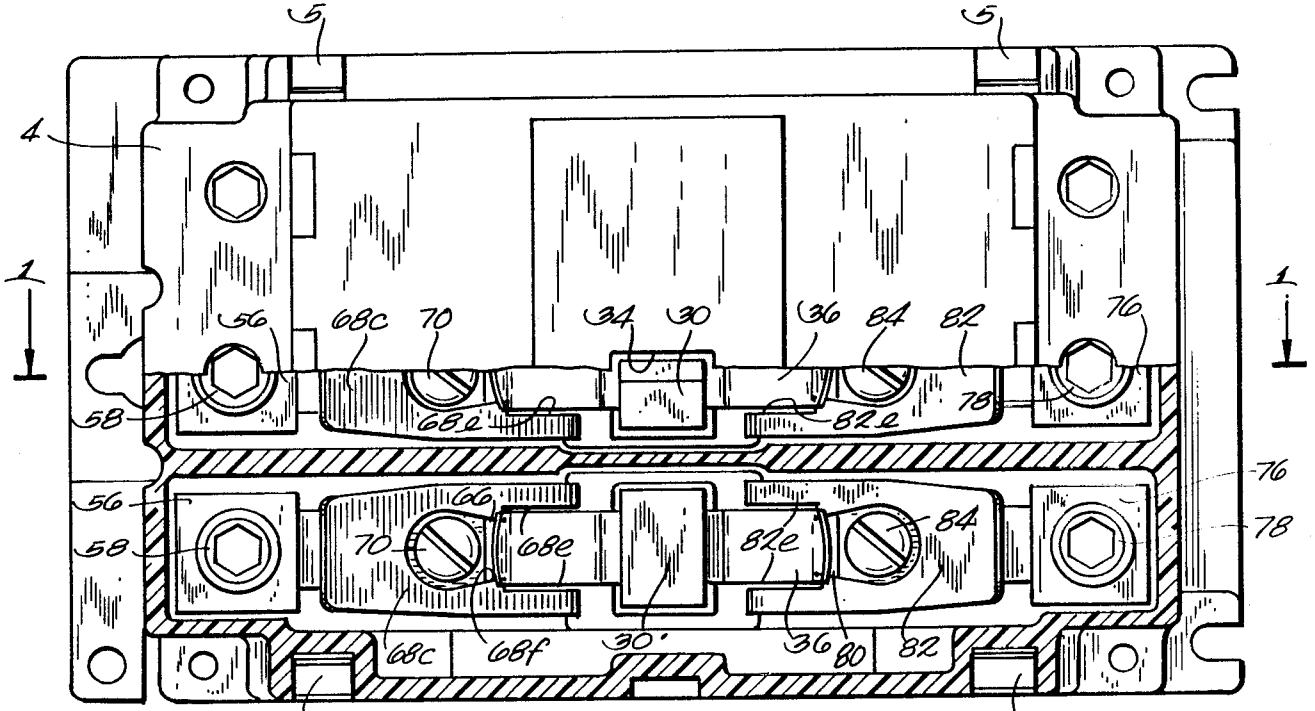
FIG. 2 is a top view of the contactor of FIG. 1 with one-half of the cover broken away at substantially line 2—2 of FIG. 1 to show a top view of the movable and stationary contacts, terminals, arc runners, the contact carrier and the terminal lugs.

Referring to FIG. 1, there is shown a high current double-break electrical contactor constructed in accordance with the invention. As shown therein, the contactor is provided with an insulating housing including a base 2 and a cover 4 connected to one another by any suitable means such as clamps 5, or the like shown in FIG. 2. While a contactor of this type may have a variable number of poles, a three-pole contactor has been illustrated for exemplary purposes as shown in FIG. 2. Base 2 is provided with a horizontal contact-supporting part 6 at its upper portion and has a compartment 8 therebelow for housing an electromagnet 10 comprising a magnet frame 12, an operating coil 14 and an armature 16. A pair of terminals 18 extend from coil 14 toward the left for connection to an electrical circuit. Base 2 is supported on a mounting plate 20 having the usual holes or the like for mounting the contactor on a mounting panel and a leaf spring 22 is positioned between mounting plate 20 and magnet frame 12 for allowing limited movement of the magnet frame with respect to armature 16. When coil 14 is energized, armature 16 is magnetically drawn to the poles of magnet frame 12 against the bias of a helical return spring 24 positioned between coil 14 and armature 16 as shown in FIG. 1. Consequently when coil 14 is deenergized, return spring 24 will lift armature 16 to its open position shown in FIG. 1.

An insulating contact carrier 26 is secured to armature 16 by conventional means such as, for example, a leaf spring 28 extending at its midportion through a hole in the armature and secured at its opposite ends into slots in contact carrier 26. Contact carrier 26 is molded of plastic material or the like and has a central upstanding movable contact carrier portion 30 that extends upwardly through a hole 32 in top portion 6 of the base and also through a hole 34 in cover 4. Hole 32 closely fits around contact carrier portion 30 to guide the latter in its reciprocal vertical movement when the electromagnet is energized and deenergized. A normally open movable bridging contact 36 is mounted on contact carrier 30 in a conventional manner. For this purpose, contact carrier 30 is provided with a lateral hole 38 therethrough having a bump 40 at its upper portion for retaining the upper end of a helical compression spring 42 the lower end of which surrounds a bump 44 on the central upper surface of movable bridging contact 36 to retain the movable bridging contact on the contact carrier and also to bias it downwardly against the lower surface 46 of hole 38, thus to provide the necessary contact pressure when the contacts close.

As shown in FIG. 1, the contactor is provided with a pair of stationary contact-terminal and arc runner assemblies 48 and 50 as shown in FIGS. 1 and 3. Left-hand terminal assembly 48 shown in FIG. 1 comprises an elongated terminal member 52 seated in a lateral groove 54 in upper member 6 of the base and having a box lug 56 secured to its outer end. Box lug 56 is of conventional rectangular form having a lateral hole therethrough and a tapped hole extending down from its top into which a set screw 58 is threaded for clamping the stripped end of an electrical wire that has been inserted in the hole therebelow. Terminal 52 is provided with means for rigidly securing the same onto upper portion 6 of the base 2. For this purpose, a screw 60 may be inserted up through a hole 62 in upper portion 6 of the base and a nut 64 is threaded on the upper end of this screw to clamp terminal 52 into its channel 54 in upper portion 6 of the base. Terminal 52 is made of electrically conductive metal such as copper. Contact-terminal and arc runner assembly 48 also comprises a contact 66 of extruded copper or the like and an arc runner 68 made from heavy gauge copper as shown in FIGS. 1 and 4. Arc runner 68 is provided with an inwardly extending horizontal portion 68*a* and a reentrant or turn-back portion 68*b* extending outwardly and upwardly to provide an arc runner portion 68*c* as shown in FIG. 1. The bight portion 68*d* of the horizontal and reentrant portions 68*a* and 68*b* is provided with a slot 68*e* as shown in FIG. 2 through which stationary contact 66 extends and extending into a clearance slot 68*f* for access to screw 70.

The contactor is also provided with means for securing stationary contact 66 and arc runner 68 to top portion 6 of the base. For this purpose, the left-hand portion 66*a* of contact 66 and the horizontal portion 68*a* of arc runner 68 are provided with holes through which a screw 70 extends into threaded engagement in a tapped hole 52*a* in terminal 52. As will be seen in FIG. 1, contact tip 66*b* of stationary contact 66 which may be silver cadmium oxide or the like extends up through slot 68*e* slightly above turn-back portion 68*b* of the arc runner for engagement by contact tip 36*a* of movable contact 36.

Contact-terminal and arc runner assembly 50 is similar to contact-terminal and arc runner assembly 48 just described except that it is on the right-hand side of the contactor and therefore in reversed relationship. Contact-terminal and arc runner assembly 50 similarly includes an elongaged terminal member 72 secured to upper portion 6 of the base by a screw 74, in this case screw 74 being threaded into a tapped hole in terminal 72 rather than being secured by a nut 64 as in the case of contact-terminal and arc runner assembly 48 hereinbefore described to show these alternative methods of securing the terminal onto the base. A similar box lug 76 is secured to the outer end of terminal 72, this box lug having a set screw 78 for clamping the stripped end of an insulated electrical wire therein. Contact-terminal and arc runner assembly 50 further includes a similar stationary contact 80 extending up through a slot in the bight portion of an arc runner 82 and both stationary contact 80 and arc runner 82 being secured by a screw 84 to terminal 72. As a result, contact tip 80*b* extends slightly above the bight portion of arc runner 82 for engagement by contact tip 36*b* of movable bridging contact 36 when the electromagnet is energized.

As shown at the left-hand portion of FIG. 1, a screw terminal 86 may additionally or alternatively be connected to elongated terminal 52 by having a perforated end portion thereof clamped under the head of screw 60.

It will be apparent from FIG. 2 that in a three-pole contactor such as the one therein illustrated, only the center pole contact carrier 30 extends up through a hole 34 in the cover for coupling to external apparatus such as, for example, an auxiliary contact set mounted thereon and that contact carriers 30' of the two poles on either side of the center pole need not extend through the cover.

As shown in FIG. 1, two sets of arc splitter plates 88 and 90 are mounted within cover 4 directly above the respective arc runners 68*c* and 82*c* to receive the arcs that are blown outwardly therealong to be broken up and extinguished.

An important aspect of the invention is to provide stationary contacts 66 and 80 that extend through and across the slotted bight portions 68*d* and 82*d* of the arc runners in order to allow straight-through current flow on low current operation when the contacts are closed to retain maximum contact pressure but to provide turn-back current conduction loops on high current operation to afford maximum arc blowout force when the contacts are opened under high current overload conditions thereby to quickly remove the electric arcs and their associated heat from the contact tips and to move the arcs outwardly along the arc runners and into the splitter plates to rupture and efficiently extinguish the same. For this purpose, the current will flow toward the right through terminal 52 and then upwardly through stationary contact 66 and its contact tip 66*b* and then through contact tip 36*a* and movable contact 36, contact tips 36*b* and 80*b*, stationary contact 80 and terminal 72. It will be apparent that this current flow was straight through the left stationary contact and then through the movable bridging contact and the right stationary contact. However, under overload conditions, the movable bridging contact 36 will be tripped open causing arcs to form between the stationary and movable contact tips which will be moved out onto the left and right arc runners 68*c* and 82*c*. It will be apparent that this will provide turn-back current conduction loops. For this purpose, current will flow through terminal 52 to the right and then upwardly through stationary contact 66 and the bight portion 68*d* of arc runner 68 and then toward the left and upwardly along arc runner 68*c* and then across the open contact gap to the left end of movable bridging contact 36 and through this movable bridging contact to the right end thereof and then through the air gap to arc runner 82*c*, to the left and downwardly along arc runner 82*c* and through stationary contact 80 and the bight portion 88*d* of the arc runner and then to the right through terminal 72. These turn-back current conduction loops will afford maximum arc blowout forces to the left and right respectively under high current conditions to quickly remove the electric arcs and their associated heat from the contacts into the arc splitter plates to rupture and efficiently extinguish the same. The size of the turnback current conduction loops will, of course, be dependent upon the relative size of the stationary contacts with respect to the bight portions of the arc runners. But the important thing is that the turn-back current conduction loops are produced only under high overload current trip conditions to get the maximum arc blowout force whereas under normal operating current conditions the current will flow straight through the contacts to maintain maximum contact pressure when it is needed.

While the apparatus hereinbefore described is effectively adapted to fulfill the objects stated, it is to be understood that the invention is not intended to be confined to the particular preferred embodiment of high current double-break electrical contactor disclosed, inasmuch as it is susceptible of various modifications without departing from the scope of the appended claims.

We claim:

1. A longer contact life high-current double-break electrical contactor comprising:

an insulating housing;

a pair of stationary contact-terminal means mounted in said housing and comprising connector terminals accessible from the exterior of said housing for attachment of electrical wires and inwardly-directed conductor portions extending laterally from said terminals toward one another into spaced-apart relation and provided thereat with reentrant conductor portions and arc-runner conductor portions made from heavy gauge copper extending from said reentrant portions at upward and outward angles and stationary contact tips above said reentrant portions;

a movable double-break bridging contact overlying said stationary contact tips;

contact carrier and actuator means for supporting and actuating said bridging contact into and out of engagement with said stationary contact tips to close and open, respectively, an electrical circuit between said terminals;

said stationary contact-terminal means also comprising conductive means providing electrically conductive paths from said conductor portions through and across the bight portions of said reentrant portions to said stationary contact tips to allow substantially straight-through current flow therethrough and through said bridging contact when said contacts are closed under normal current conditions to retain maximum contact pressure;

and said reentrant conductor portions and said arc-runner conductor portions providing turn-back current conduction loops to afford maximum arc blowout force when said contacts are opened under high current conditions thereby to quickly remove the electric arcs and their associated heat from said contact tips and to move said arcs outwardly along said arc-runner conductor portions to rupture and efficiently extinguish the same.

2. The longer contact life high-current double-break electrical contactor as claimed in claim 1, wherein:

said re-entrant portions are generally V-shaped and have slots in bight portions thereof, and said conductive means comprises solid blocks of electrically conductive material affixed to said inwardly-directed conductive portions and extending upwardly through said slots, said stationary contact tips being affixed to upper surfaces of said blocks.

* * * * *